United States Patent [19]

Prusas

[11] Patent Number: 4,486,267

[45] Date of Patent: Dec. 4, 1984

[54] CHEMITHERMOMECHANICAL PULPING PROCESS EMPLOYING SEPARATE ALKALI AND SULFITE TREATMENTS

[75] Inventor: Zenon C. Prusas, Chillicothe, Ohio

[73] Assignee: Mead Corporation, Dayton, Ohio

[21] Appl. No.: 551,392

[22] Filed: Nov. 14, 1983

[51] Int. Cl.[3] ..... D21B 1/02

[52] U.S. Cl. ..... 162/25; 162/26; 162/28; 162/86; 162/71

[58] Field of Search ..... 162/25, 26, 28, 19, 162/71, 18, 83, 84, 86

[56] References Cited

U.S. PATENT DOCUMENTS

| | | |
|---|---|---|
| 3,016,324 | 1/1962 | Textor . |
| 3,168,433 | 2/1965 | Ferrigan, Jr. et al. . |
| 3,177,110 | 4/1965 | Ogait . |
| 3,354,030 | 11/1967 | Williams et al. . |
| 3,479,249 | 11/1969 | Kalisch . |
| 3,558,428 | 1/1971 | Asplund et al. . |
| 3,597,310 | 8/1971 | Sumi et al. ..... 162/26 |
| 3,617,435 | 11/1971 | Kalisch . |
| 3,795,574 | 3/1974 | Kalisch . |
| 4,116,758 | 9/1978 | Ford et al. . |
| 4,187,141 | 2/1980 | Ahrel . |
| 4,211,605 | 7/1980 | Saxton et al. . |
| 4,259,148 | 3/1981 | Beath et al. . |

OTHER PUBLICATIONS

Katz et al., "A Mechanism for the Alkali Strengthening of Mechanical Pulps," TAPPI, Jul., 1981.

Chemical Abstract, 98: 127956V.

Casey, "Pulp and Paper Chemistry and Chemical Technology".

Lachenal et al., "Hardwood Hydrogen Peroxide Chemimechanical Pulps", TAPPI, May, 1979.

*Primary Examiner*—William Smith

*Attorney, Agent, or Firm*—Biebel, French & Nauman

[57] ABSTRACT

A high yield chemithermomechanical (CTMP) process for obtaining high strength hardwood pulps is disclosed wherein hardwood chips are subjected to a two-stage chemical treatment prior to defibration, the first consisting of chip impregnation and reaction with an alkaline liquor followed by a second stage treatment with sulfite and/or bisulfite; in one embodiment peroxide is added to the alkaline liquor to enhance brightness.

16 Claims, No Drawings

CHEMITHERMOMECHANICAL PULPING PROCESS EMPLOYING SEPARATE ALKALI AND SULFITE TREATMENTS

BACKGROUND OF THE INVENTION

The present invention relates to a process for the production of a high yield, high strength chemithermomechanical (CTMP) pulp from hardwood and, more particularly, to a chemithermomechanical pulping process employing a two-stage chemical treatment wherein hardwood chips are sequentially treated first with an alkaline liquor and then with a sulfite liquor to chemically soften them prior to mechanical defibration.

In recent years there has been increased use of bleached hardwood chemical pulps in the manufacture of papers and, particularly, printing papers. These pulps have relatively high strength as compared to the refiner pulps. They are frequently combined with long fiber pulps to improve the printability of the finished paper.

A demand for a higher yield hardwood pulping process has accompanied the increased use of hardwood pulps.

In wood lignin, concentrated in the intercellular layer known as the middle lamella, cements the cellulose fibers to each other. The main purpose of chemical pulping processes, such as sulfite pulping, is to dissolve this layer so that the wood structure breaks down into individual fibers without the use of substantial mechanical action. This is accomplished by cooking the wood chips at high chemical concentrations and high temperatures for a prolonged period of time and results in low yields based on the dry chips because a substantial amount of the wood, particularly lignin, is removed.

The Kraft process and the sulfite pulping process are examples of chemical pulping processes in which lignin is removed from the wood. They are relatively low yield processes as they typically yield about 40 to 60% based on dry chips depending on the wood and the conditions employed. Typical acid sulfite pulping processes involve cooking the wood chips at temperatures of about 120 to 150° C. and pressures in excess of one atmosphere for 5 hours or more. In alkaline sulfite chemical pulping processes, temperatures as high as 180° C. are sometimes used.

One attempt which has been made to improve the yield of sulfite pulps, which is relevant from the standpoint of the present invention, involves pre-treating the chips by holding them in an alkaline solution for a period of time. Examples of such sulfite pulping processes are described in U.S. Pat. No. 3,177,110 to Ogait and U.S. Pat. No. 3,354,030 to Williams. However, these processes remain essentially chemical pulping processes which rely upon the removal of most of the lignin from the wood and do not provide high overall yields. For example, the yields illustrated in the Ogait patent only range from about 55 to 65%. By contrast, the major portion of the lignin is retained in CTMP processes due to the use of much milder conditions in the chemical treatments.

U.S. Pat. Nos. 3,479,249; 3,617,435; and 4,795,574 to Kalisch describe a semi-chemical sulfite pulping process which can be considered a hybrid of the prior chemical processes described above and the prior chemimechanical pulping processes described later.

In accordance with the teachings of the Kalisch patents, pulping is accomplished by impregnating wood chips with sodium hydroxide or sodium carbonate and, thereafter, cooking the chips in an aqueous solution of sulfur dioxide for 2 to 3 hours. In the latter treatment, the sodium hydroxide or sodium carbonate in the chips reacts with sulfur dioxide to produce bisulfite in the chips which reacts with the lignin to solubilize it in a known manner. After cooking, the chips are defibered by passing them once through a disc refiner. While the Kalisch process provides higher yields than obtained in chemical sulfite pulping processes, the yields reported in the patent are about 75% or less.

Mild sulfite treatments have been used in chemimechanical pulping processes to chemically soften the wood fibers and thereby facilitate mechanical defibration. It is known that sulfonation renders lignin more hydrophilic or less hydrophobic so that the fibers swell in the sulfite liquor and the chips become easier to defibrate. These chemimechanical processes produce higher yields than chemical or semi-chemical processes, but the pulp strength is not as good. Typically they are also more effective with softwoods than hardwoods.

U.S. Pat. No. 4,116,758 to Ford et al describes a process which is especialy suited to softwood pulps whereby wood chips are softened prior to defibration by sulfonating the lignin without substantially removing it from the wood. This is typically accomplished by maintaining the wood chips in a solution containing 50 to 180 g/l sodium sulfite at 100 to 140° C. for approximately 30 to 60 minutes without an alkaline pre-treatment and is followed by disc refining. The Ford et al process is characterized in that a level of sulfonation is achieved which is at least 85% of the maximum degree of sulfonation that can be achieved without reducing the pulp yield below 90%.

Asplund, U.S. Pat. No. 3,558,428, teaches a chemimechanical pulping process employing a sulfite treatment wherein more rapid and effective impregnation of the sulfite is obtained by pre-impregnating steamed wood chips with an alkaline hydroxide solution. To avoid discoloration, this pre-impregnation step is limited to a very short duration and functions to implant hydroxide in the wood fibers without allowing it to react substantially with the hemicellulose and other wood components to swell the fibers as in other alkaline chemimechanical pulping processes. Immediately after impregnating the fibers with sodium hydroxide liquor, the chips are sluiced into a pressure vessel which is simultaneously supplied with gaseous sulfur dioxide and steam. In the pressure vessel the sodium hydroxide in the fibers rapidly reacts with the sulfur dioxide to produce bisulfite. The chips are retained in the pressure vessel for 1 to 20 minutes after which they are mechanically defibrated.

The Asplund pulping process can be classified as a single stage CTMP process because the reaction of the chemicals with the wood proceeds only after the alkali combines with sulfur dioxide. Therefore, the Asplund process must be contrasted with the teachings of this invention where the chemical treatment proceeds sequentially in two distinctly separate stages using two different chemical liquors. The conditions of chemical treatments also differ as explained later.

A chemimechanical process for treating beechwood chips wherein the chips are impregnated with a solution containing sodium hydroxide and sodium sulfite is also described in the literature by Patt et al, "Studies on the Production of Chemimechanical Pulps from Beech and Birch", *Holz Roh. Werkst.*, 41(2), pp. 51–4, (1983). Textor, U.S. Pat. No. 3,016,324 also discloses a chemimechanical pulping process wherein wood chips may be impregnated with sodium sulfite liquor by squeezing the chips in a screwpress and spraying the chips emerging from the press with sulfite liquor and then defibrating.

Chemimechanical pulping processes in which the chips are impregnated with alkaline liquors are also known.

One proposed mechanism by which the use of alkali, such as caustic soda, increases the strength of mechanical pulps is by increasing the number of acidic groups in the wood (see S. Katz et al, "A Mechanism for the Alkali Strengthening of Mechanical Pulps", *TAPPI*, Vol. 64, No. 7, pp. 97–100, July, 1981). The counterions of these acidic groups are said to draw additional water into the cell wall and the accompanying swelling and plasticization enhance the ability of the fibers to bond and the overall strength of the pulp improves.

U.S. Pat. No. 4,187,141 to Ahrel discloses a process for producing bleached chemimechanical pulp wherein screwpressed wood chips are subjected to a two-stage impregnation with an alkaline peroxide solution in which the impregnated chips are introduced into a pressure vessel and ground between a pair of rotating discs. This process provides a pulp having high brightness but relatively low strength.

Lachenal et al, in an article entitled "Hardwood Hydrogen Peroxide Chemimechanical Pulps", *TAPPI*, Vol. 62, No. 5, pp. 53–57 (May, 1979) discloses a process for producing bleached hardwood hydrogen peroxide chemimechanical pulps wherein hardwood chips are impregnated with an alkaline peroxide liquor, allowed to stand for 1.5 to 2 hours at 40° to 60° C., and defibered by passing the impregnated chips through a Sprout-Waldron laboratory refiner at a consistency of about 5%. The chips are destructured in a cylinder press prior to impregnating the relaxed chips by mixing them with an alkaline peroxide liquor at a liquor to wood ratio of 3.5 to 1.

While chemimechanical and chemithermomechanical processes have been used in the production of hardwood pulps in the past, they have not provided high strength. Thus, there is a need for a high yield, high strength process for pulping hardwoods.

SUMMARY OF THE INVENTION

It is a principal object of the present invention to provide a high yield, high strength chemithermomechanical pulp from hardwood chips.

In accordance with the present invention, a chemithermomechanical pulp is obtained from hardwood chips by a process which comprises the steps of:

(a) impregnating hardwood chips with an alkaline liquor having a pH greater than 7.5 and containing about 3 to 10% sodium hydroxide based on bone dry wood chips, (b) maintaining the impregnated wood chips of step (a) for a time sufficient to permit chemical softening and swelling of the chips, (c) removing the alkaline liquor from the chips of step (b), (d) impregnating the chips with a sulfite liquor containing about 2 to 10% sodium sulfite and/or sodium bisulfite based on bone dry wood chips, (e) cooking the chips in the sulfite liquor at a temperature of about 100° to 180° C. for a time sufficient to sulfonate the lignin in the chips without removing a substantial amount of lignin from the chips, (f) mechanically defibrating the chips of step (e), and (g) recovering the wood pulp.

In accordance with the present invention, two separate stages of chemical treatment are used to soften the chips and prepare them for mechanical defibration. In the first stage, the primary function of treatment is to swell the hemicellulose fraction in the fibers with alkali. This makes the fibers more flexible and conformable and improves the interfiber bonding potential of the pulp. It is also believed that chip swelling with alkali prior to the sulfite treatment facilitates penetration of sulfite and/or bisulfite into the chips and improves the efficiency of the sulfite reaction.

The primary function of the sulfite treatment in the second stage is to sulfonate the lignin. Lignin is a hydrophobic material and prevents fiber swelling by water. It also interferes with interfiber bonding by keeping the fibers stiff and nonconformable. Through sulfonation, lignin becomes more hydrophilic and allows additional fiber swelling and, consequently, additional interfiber bonding.

In the foregoing manner, the process of the present invention improves the condition of both major fractions of the fiber, namely, that of carbohydrates (primarily the hemicelluloses) and lignin. In contrast, previous high yield processes have concentrated either on swelling the hemicelluloses (processes based on impregnation with alkalis) or on sulfonation of lignin to make it more hydrophilic (sulfite CTMP processes). By combining both features in one process in the present invention, it is possible to produce high strength and high yield pulps.

The process of the present invention can be carried out on a batch or continuous basis. To enhance impregnation, the chips are preferably pre-steamed and destructured before being impregnated with the alkaline liquor. In accordance with several embodiments of the invention, peroxide is added to the alkaline liquor in the first stage to enhance the brightness of the pulp.

The process of the present invention is particularly useful in treating hardwood chips and provides high strength properties, particularly a combination of burst, tensile and fold strength properties, which are superior to chemimechanical or chemithermomechanical pulps obtained by impregnating the chips with either a sulfite liquor or an alkali liquor alone or a combined alkali-sulfite liquor in a single stage. Yields in excess of 85% are usually obtained.

DETAILED DESCRIPTION OF THE INVENTION

The process of the present invention can be used in pulping hardwood chips such as aspen, oak, maple, and birch chips. It can also be used on softwoods, but the advantages are less pronounced. The resulting hardwood pulp can be used as a substitute for more expensive chemical pulps. It is particularly adaptable for use as a short-fiber pulp alone or in admixture with long fiber pulps in the manufacture of printing papers but can also be used as a component of, for example, tissue or absorbent papers or any other papers where hardwood chemical pulps are presently employed.

The chemithermomechanical pulping process of the present invention is characterized by a two-stage chemical treatment prior to refining wherein the hardwood chips are first impregnated and reacted with an alkaline liquor, squeezed or drained, and then impregnated with a sulfite or bisulfite liquor followed by a short cook.

The alkaline treatment is usually carried out under ambient temperature and pressure conditions. The sulfite treatment is carried out under relatively mild CTMP conditions.

Before impregnating the chips with the alkaline liquor, the chips are usually destructured or shredded to enhance their penetration by the chemical liquors. This can be accomplished using any suitable comminuting machine such as a hammermill, attrition mill, cylinder press, or heavy duty screwpress. Destructuring of the chips can be facilitated by pre-treating the chips with steam to soften them.

The type of destructuring treatment that is desirable will depend on the nature and age of the chips. In the preferred case, the chips leave the destructuring apparatus in a compressed state and expand in the alkaline impregnation liquor. In this manner the chips rapidly imbibe the impregnation liquor and the duration of the alkaline impregnation stage can thereby be shortened.

The alkaline liquor should contain about 3.0 to about 10% by weight and preferably about 4 to 8% by weight sodium hydroxide based on the amount of bone dry wood chips. Above 10% sodium hydroxide may be used, but the benefits of the added sodium hydroxide are usually minimal. The alkaline liquor to wood volumetric ratio usually ranges from about 8:1 to 1.5:1 and, more preferably, about 2:1 in this stage of the process. In the latter case, the excess liquor is normally drained off after impregnation.

Where high brightness is desired, the alkaline liquor may contain from about 0.5 to 4% by weight and, more preferably, about 1 to about 3% by weight, hydrogen peroxide based on the amount of oven dried wood chips. The amount of hydrogen peroxide that is used will vary depending on the degree of bleaching that is desired and the type and age of the wood chips used. It is often desirable to use a higher amount of peroxide with oak chips than, for example, aspen chips. More than 4% peroxide can be used but the improvement in brightness that is obtained usually does not justify the expense of the additional chemical. Stoichiometric amounts of sodium peroxide can be substituted for all or part of the hydrogen peroxide and all or part of the sodium hydroxide if desired.

When peroxide is used, the alkaline liquor preferably contains a chelating agent or other complexing agent to prevent decomposition of the peroxide by metal ions such as iron and manganese ions in the wood. Preferred chelating agents are organic agents such as diethylenetriaminepentacetic acid (DTPA), 2-hydroxyethylethylenediaminetriacetic acid (HEDTA), ethylenediaminetetracetic acid (EDTA), and diethylenetriaminepenta(methylenephosphonic) acid, and their alkali metal salts. The use of about 0.5% DTPA on a dried wood chip basis has been found to give particularly beneficial results. If it is desired to recover sodium hydroxide from the spent impregnation liquor, inorganic complexing agents such as sodium silicate should be avoided since they precipitate in the evaporators that are used for chemical recovery and forms a scale which is very difficult to remove.

The alkali treatment is usually carried out under ambient conditions, however, temperatures ranging from about 20° C. to about 80° C. may be used.

The wood chips impregnated with the alkaline liquor are held for a period of time sufficient to soften the chips and swell the cellulose and hemicelluloses, thereby enabling the fibers to be more easily separated during the subsequent mechanical defibrating step. This typically can be accomplished within a period of time of about 5 minutes to about 3 hours and usually 20 to 30 minutes depending on the temperature, size and type of wood chips. For example, aspen chips are preferably held for about 10 to 20 minutes at a temperature of about 40° to 70° C. Oak chips take longer to soften.

After sufficient softening has been accomplished in the alkaline liquor, the alkaline liquor is removed from the chips. This may be accomplished by either compressing the chips or simply allowing the chips to drain. In the preferred case, the wood chips are compressed in a screwpress which is adapted to remove the alkaline liquor and to submerge the chips immediately in the sulfite liquor where the chips expand while immersed in the sulfite liquor. Thereafter, the impregnated chips can be transported to a pressurized steam chamber in which the chips are reacted in the vapor phase or the chips can be reacted in the sulfite bath in the liquid phase.

The chips are mildly cooked to sulfonate the lignin without removing it from the chips. This treatment is typically carried out at temperatures of about 120° to 180° C. and, more typically, about 140° to 160° C. in a steam pressurized vessel.

The sulfite liquor generally contains approximately 2 to 10% by weight sodium sulfite, sodium bisulfite or a mixture thereof and, more preferably, about 4 to 8% by weight based on bone dry wood chips. If in excess of 10% sulfite is used there will generally be residual sulfite present. The sulfite liquor to wood volumetric ratio is usually in the range of about 8:1 to 1.5:1 and preferably about 2:1. Usually enough liquor is present to completely immerse the chips.

It has been found desirable to use an acidic to slightly alkaline sulfite liquor (pH from about 5 to 9). The relative amount of sulfite and bisulfite used in the impregnation liquor can be adjusted in order to obtain a chip pH of about 7 to 9 after the sulfite impregnation. For example, a liquor containing sodium sulfite has a pH of about 9, whereas a sodium bisulfite liquor has a pH of about 5.

By using a mixture of sodium sulfite and sodium bisulfite, the pH of the chips can be adjusted within the aforesaid range. Where high brightness is desired, the pH of the chips should not be allowed to remain highly alkaline too long. For this purpose, more bisulfite can be used in the sulfite liquor to provide a pre-refining pH of 7 to 8. Where brightness is less critical and high strength is desired, sulfite alone or in combination with less bisulfite can be used to provide a pre-refining pulp pH of about 8 to 9.

The duration of the sulfite treatment is limited to prevent the sulfonated lignin from being removed from the chips in the course of the treatment. At the same time, the sulfite treatment must be of sufficiently long duration to enhance the softness and conformabilty of the fibers. Thus, the duration of the sulfite treatment will vary with the nature of the chips and the temperature of the treatment, but typical treatments run from about 15 to 45 minutes and, more preferably, 20 to 30 minutes. In no event should the sulfite treatment be conducted under conditions which reduce the yield of this CTMP process below 80% based on bone dry chips.

In the preferred case, the chips impregnated with sulfite liquor are drained first to remove excess liquor and mildly cooked for a short time in vapor phase in a pressure vessel. Cooking could also be done in a liquid phase.

The chips can be defibrated in a conventional pressurized refining apparatus such as a disc refiner. A typical refiner which can be used in the process of this invention is a C-E Bauer double disc refiner.

The consistency of the chips during the refining step is generally about 10 to 35% and, preferably, about 20 to 30%. It is not necessary to control the temperature in the refiner in this invention. Temperatures in the refining zone are generally in excess of 100° C. If desired, the defibrated pulp can be further refined in one or more atmospheric refining steps. If higher brightness is desirable, the pulp may be additionally bleached by one or more known bleaching steps.

In the practice of this invention, yields of pulp based on wood chips which exceed 80% and are generally on the order of 85 to 90% or better are available. The process can be carried out on a continuous or a batch basis using conventional techniques and equipment.

The following non-limiting examples further illustrate the preferred embodiments of this invention and the advantages obtained thereby. All pulp tests were performed in accordance with TAPPI standard testing procedures.

EXAMPLE 1

Three runs were made on a Sunds Defibrator pilot plant unit containing a Defibrator 300 CD disc refiner for primary refining and Raffinator RO 20 disc refiner for secondary refining, both connected in series by a two inch pipe and a cyclone. In Run No. 1, fresh northern hardwood chips containing 60% maple were presteamed with low pressure steam in a hopper and then compressed by a feed screw in a continuous operation. The feed screw delivered compressed chips to a digester containing two chambers. The first chamber was used for chips impregnation and was partially filled with liquor containing caustic, hydrogen peroxide, and DTPA. The second chamber served as a retention vessel. Both chambers were under atmospheric pressure. Impregnation chemicals were continuously injected into the first chamber where the compressed chips were submerged for about 10 minutes. The chips absorbed 5.1% caustic, 1.9% $H_2O_2$ and 0.25% DTPA, based on bone dry wood substance. Impregnated chips were lifted from the first chamber while allowing the excess liquor to drain off and move into the second chamber for steeping. These chips were gradually removed from the chamber and stored for about 2 hours to accumulate enough material for the second stage of the process. The long chip storage time was due to the fact that the same equipment was used for both stages of chemical treatment. It is known from experience that such a long storage time is not needed.

The second stage was accomplished by continuously feeding the once impregnated chips back into the hopper of the Sunds Defibrator units. No chip presteaming was done in the second stage. Spent impregnation chemicals were partially removed during the compression in the feed screw together with dissolved wood substance. Impregnation of the compressed chips with new chemicals (5.1% sodium sulfite, based on bone dry wood) was accomplished in the first chamber of the unit and the chips were removed to the second chamber. The impregnated chips were then cooked at 150° C. for 28 minutes in the second chamber which was heated with steam. From there the chips were screw fed into the primary refiner followed by secondary refining in Raffinator RO 20. The properties of the pulp obtained are provided in Table 1 below.

For comparison Run No. 2, a two-stage sulfite CTMP process, was carried out in which caustic, peroxide and DTPA used in the first stage of Run No. 1 were replaced with sodium sulfite at a comparable application level of 5%. Otherwise the conditions used for the first and the second impregnation stages were similar to those of Run No. 1 with the first stage impregnation being carried out at ambient temperature and the second stage impregnation being carried out at 150° C.

A third run (Run No. 3) was made with a two-stage alkaline impregnation CMP process in which caustic, peroxide, and DTPA were used in both the first and second impregnation stages. Both alkaline impregnation stages were accomplished under ambient conditions and the pulp from the first refiner was conveyed to the second refiner by a screw conveyor. The pulp was acidified with sodium bisulfite after secondary refining. Otherwise the conditions were similar to those of Run No. 1. The amount of the pulping chemicals the refining conditions, and the pulp properties are shown in Table 1.

TABLE 1

| Chemicals Conditions | Run No. 1 | Run No. 2 | Run No. 3 |
|---|---|---|---|
| First Stage: | | | |
| NaOH, % | 5.1 | — | 5.1 |
| $H_2O_2$, % | 1.0 | — | 1.0 |
| DTPA, % | 0.25 | — | 0.25 |
| $Na_2SO_3$, % | — | 5.0 | — |
| Second Stage: | | | |
| NaOH, % | — | — | 5.5 |
| $H_2O_2$, % | — | — | 1.0 |
| $Na_2SiO_3$, % | — | — | 3.0 |
| $Na_2SO_3$, % | 5.0 | 5.2 | — |
| Consistency During Refining, % | | | |
| Primary Refiner | 14.9 | 14.1 | 17.6 |
| Secondary Refiner | 14.0 | 13.9 | 14.6 |
| pH Secondary Refiner | 8.1 | 6.0 | 11.8* |
| Pulp Yield, % | 88.3 | 91.6 | 85.2 |
| Pulp Brightness | 50.5 | 59.1 | 49.0 |
| Handsheet Properties After Latency Removal: | | | |
| C.S. Freeness, ml | 135 | 175 | 170 |
| Tear Factor | 57.5 | 28.6 | 43.9 |
| Burst Factor | 28:7 | 9.7 | 17.6 |
| Tensile, b.l.m. | 4980 | 2233 | 3182 |
| MIT Fold | 32 | 0 | 4 |
| Bulk, cc/g | 1.67 | 2.55 | 2.05 |
| TAPPI Opacity | 80.5 | 87.4 | 80.7 |

*Acidified to pH 6.0 after refining

The results in Table 1 show that at equivalent chemical levels, the two-stage alkali-sulfite process of the present invention provides superior pulp strength than either a two-stage sulfite CTMP or a two-stage alkaline CMP process.

EXAMPLE 2

A run (Run No. 4) was made on the same Sunds Defibrator unit described in Example 1 using aged northern hardwood chips containing 60% maple. Processing conditions were essentially the same as in Run No. 1 except that peroxide and DTPA were not used in the first stage. For comparison runs were made using a single stage alkaline sulfite CTMP process (Run No. 5), a single stage sulfite CTMP process (Run No. 6), a single stage alkaline CMP process (Run No. 7), and a refiner mechanical pulping process (Run No. 8). Runs 5, 6 and 7 were made on the Sunds Defibrator unit described above. The levels of impregnation chemicals used and process conditions for Runs, 5, 6 and 7 were similar to those used in the second stage of Run No. 4. No impregnation with chemicals was used in Run No. 7. The chemical levels, pulping conditions and pulp properties are set forth in Table 2 below:

TABLE 2

| Chemicals/ Conditions | Run No. 4 | Run No. 5 | Run No. 6 | Run No. 7 | Run No. 8 |
|---|---|---|---|---|---|
| First Stage: | | | | | |
| NaOH, % | 5.0 | 5.1 | — | 10.4 | — |
| $Na_2SO_3$, % | — | 4.8 | 10.5 | — | — |
| Retention Time (min.) | 120 | 30 | 30 | 15 | — |
| Vessel Temp. (°C.) | Amb. | 151 | 149 | 40 | — |
| Second Stage: | | | | | |
| $Na_2SO_3$, % | 5.1 | — | — | — | — |
| Retention Time (min.) | 30 | — | — | — | — |
| Vessel Temp. (°C.) | 150 | — | — | — | — |
| Consistency During Refining, % | | | | | |
| First Stage | 15.9 | 13.8 | 17.1 | 22.2 | 10.9 |
| Second Stage | 15.1 | 12.4 | 17.0 | 18.4 | 10.1 |
| pH Secondary Refiner | 8.8 | 8.7 | 6.2 | 12.0* | 5.1 |
| Pulp Brightness | 35.0 | 32.1 | 56.9 | 37.9 | 36.5 |
| Handsheet Properties After Latency Removal: | | | | | |
| C.S. Freeness ml | 110 | 120 | 135 | 115 | 150 |
| Tear Factor | 48.2 | 48.9 | 37.3 | 57.5 | 16.6 |
| Burst Factor | 23.3 | 19.1 | 15.6 | 19.3 | 2.7 |
| Tensile, b.l.m. | 4565 | 3882 | 3226 | 4269 | 775 |
| MIT Fold | 17 | 7 | 2 | 8 | 0 |
| Bulk, cc/g | 1.72 | 1.87 | 2.25 | 1.92 | 3.81 |
| TAPPI Opacity | 87.3 | 93.0 | 85.3 | 87.6 | 92.5 |

*Acidified to pH 6.1 after refining

The data in Table 2 shows that superior pulp properties and particularly burst, tensile and fold strength are achieved using the two-stage alkali-sulfite CTMP process of the present invention as compared to single stage CTMP and CMP processes when equivalent chemical levels are used. Furthermore, the higher bulk obtained in Run 5 as compared to Run 4 indicates that the fibers are swollen less in the single stage alkaline sulfite treatment.

EXAMPLE 3

Using the same Sunds Defibrator unit as in Example 1 and operating conditions similar to those described for Runs 1 and 4, white birch chips were subjected to the alkaline sulfite CTMP process of the present invention (Run No. 9). A single stage sulfite CTMP process was (Run No. 10) was run for comparison at a comparable level of chemicals. Operation conditions for Run No. 10 were similar to those of second stage of Run No. 9, i.e., in both cases, the chips were impregnated with sodium sulfite and cooked for about 30 minutes at 150° C. The results are shown in Table 3.

TABLE 3

| Chemicals/ Conditions | Run No. 9 | Run No. 10 |
|---|---|---|
| First Stage: | | |
| NaOH, % | 5.0 | — |
| $Na_2SO_3$, % | — | 10.0 |
| Second Stage: | | |

TABLE 3-continued

| Chemicals/ Conditions | Run No. 9 | Run No. 10 |
|---|---|---|
| $Na_2SO_3$, % | 5.0 | — |
| Consistency During Refining, % | | |
| First Stage | 14.9 | 14.0 |
| Second Stage | 13.3 | 11.6 |
| pH Secondary Refiner | 6.7 | 6.0 |
| Pulp Brightness | 45.4 | 53.6 |
| Pulmac Shives, % | None | None |
| Handsheet Properties After Latency Removal: | | |
| C.S. Freeness, ml | 70 | 110 |
| Tear Factor | 68.1 | 51.4 |
| Burst Factor | 45.6 | 23.9 |
| Tensile, b.l.m. | 6353 | 5023 |
| MIT Fold | 272 | 13 |
| Bulk, cc/g | 1.54 | 1.92 |
| TAPPI Opacity | 81.7 | 90.3 |

The data in Table 3 indicates that on birch a two-stage alkali-sulfite CTMP process results in a pulp which is as strong as a fully cooked chemical hardwood kraft pulp. Its burst strength is about 2 times higher than that of a pulp made in a conventional single stage sulfite CTMP process while fold is higher by a factor of 21.

EXAMPLE 4

Aspen chips were subjected to the alkali-sulfite two-stage CTMP process of the present invention (Run No. 11) on the Sunds Defibrator pilot plant equipment described in Example 1 using essentially the same conditions as described for Run No. 1. A comparison run (Run No. 12) was also made in which essentially the same chemical levels were applied in a single stage CTMP process operation using the same operating conditions as those in the second stage of Run No. 11. A further comparison run (Run No. 13) was made using a sulfite CTMP process at a comparable chemical level.

TABLE 4

| Chemicals/ Conditions | Run No. 11 | Run No. 12 | Run No. 13 |
|---|---|---|---|
| First Stage: | | | |
| NaOH, % | 5.0 | 5.0 | — |
| $Na_2SO_3$, % | — | 5.1 | 10.0 |
| Vessel Temp. (°C.) | Amb. | 150 | 150 |
| Retention Time (min.) | 120+ | 30 | 30 |
| Second Stage: | | | |
| $Na_2SO_3$, % | 5.0 | — | — |
| Vessel Temp. (°C.) | 150 | — | — |
| Retention Time (min.) | 30 | — | — |
| Consistency During Refining, % | | | |
| First Stage | 13.8 | 12.0 | — |
| Second Stage | 12.0 | 9.8 | — |
| pH Secondary Refiner | 8.3 | 8.5 | 6.2 |
| Pulp Yield, % | 84.8 | 82.5 | 88.9 |
| Pulp Brightness | 40.9 | 35.4 | 61.1 |
| Handsheet Properties After Latency Removal: | | | |
| C.S. Freeness, ml | 95 | 95 | 85 |
| Tear Factor | 68.8 | 71.4 | 56.2 |
| Burst Factor | 41.2 | 32.3 | 23.8 |
| Tensile, b.l.m. | 5776 | 5127 | 4639 |
| MIT Fold | 138 | 56 | 15 |
| Bulk, cc/g | 1.41 | 1.52 | 1.79 |
| TAPPI Opacity | 81.0 | 90.3 | 86.9 |

The data in Table 4 show that the two stage alkali-sulfite process is superior to a single stage alkaline-sulfite CTMP process or a single stage sulfite CTMP process in terms of both pulp strength and brightness and the comparison of bulk density confirms that more swelling is achieved using the two stage treatment of the present invention as compared to the other processes.

EXAMPLE 5

Poor quality aged commercial Appalachian hardwood chips (primarily whole tree chips and chips made from undebarked pulpwood having a bark content of 7% and oak being the primary species) were made into a pulp using the two stage alkali-sulfite CTMP process of the present invention (Run No. 14). The Sunds Defibrator pilot plant described in Example 1 was used and the conditions described for Run No. 1 were followed.

Three comparison runs were made. In Run No. 15, the chips were subjected to a single stage alkaline sulfite CTMP process. In Run No. 16, the chips were subjected to a single stage sulfite CTMP process and in Run No. 17 a conventional refiner mechanical pulping process was used. Chemical levels, refining conditions and pulp properties are set forth in Table 5:

TABLE 5

| Chemicals/ Conditions | Run No. 14 | Run No. 15 | Run No. 16 | Run No. 17 |
|---|---|---|---|---|
| First Stage: | | | | |
| NaOH, % | 5.0 | 5.0 | — | — |
| $Na_2SO_3$, % | — | 5.3 | 10.2 | — |
| Retention Time (min.) | 120+ | 25 | 30 | — |
| Vessel Temp. (°C.) | Amb. | 150 | 150 | — |
| Second Stage: | | | | |
| $Na_2SO_3$, % | 5.1 | — | — | — |
| Retention Time (min.) | 30 | — | — | — |
| Vessel Temp. (°C.) | 150 | — | — | — |
| Consistency During Refining, % | | | | |
| First Stage | 16.2 | 15.9 | 17.2 | 15.2 |
| Second Stage | 12.7 | 12.6 | 14.4 | 13.7 |
| pH Secondary Refiner | 7.7 | 8.5 | 6.0 | 5.1 |
| Pulp Yield, % | 81.7 | 79.0 | 84.5 | 96.4 |
| Pulp Brightness | 34.9 | 22.7 | 37.7 | 30.7 |
| Handsheet Properties After Latency Removal: | | | | |
| C.S. Freeness, ml | 100 | 100 | 90 | 150 |
| Tear Factor | 66.6 | 63.7 | 37.3 | 19.0 |
| Burst Factor | 23.1 | 19.7 | 15.6 | 3.0 |
| Tensile, b.l.m. | 4137 | 3763 | 2900 | 779 |
| MIT Fold | 14 | 8 | 3 | 0 |
| Bulk, cc/g | 1.91 | 2.02 | 2.29 | 4.17 |
| TAPPI Opacity | 95.7 | 97.9 | 89.1 | 99.8 |

Table 5 indicates that a fairly strong pulp can be produced even from poor quality hardwood chips using the two stage alkali-sulfite CTMP process of the present invention. This is illustrated vividly by comparison to Run No. 17 which shows that a mechanical pulp made from these chips in a conventional manner could not be used commercially due to its extremely poor strength. In comparison to the single stage alkaline sulfite CTMP (Run 15), the two stage process of the present invention resulted in a significantly higher brightness in addition to a higher strength.

Having described the invention in detail and by reference to specific embodiments thereof, it will be apparent that numerous modifications and variations are possible without departing from the scope of the invention as defined by the following claims.

What is claimed is:

1. A process for the production of hardwood chemithermomechanical pulp, said process being characterized by a pulp yield of at least 80% based on dry wood chips, said process comprising the steps of:

(a) impregnating hardwood chips with an alkaline liquor, said alkaline liquor being an aqueous solution containing about 3 to 10% sodium hydroxide based on bone dry chips;

(b) maintaining said impregnated chips of step (a) for a period of time sufficient to permit chemical softening of said chips;

(c) removing said alkaline liquor from said chips;

(d) impregnating said alkaline softened chips with a sulfite liquor, said sulfite liquor being an aqueous solution containing about 2 to 10% by weight sodium sulfite or sodium bisulfite based on dry wood chips;

(e) cooking the impregnated chips of step (d) in said sulfite liquor at a temperature of approximately 120° to 180° C. for a period of time sufficient to sulfonate the lignin in said chips and further soften said chips without removing substantial amounts of lignin; and (f) defibrating the chips of step (e) by passing said chips through a refining apparatus.

2. The pulping process of claim 1 wherein said hardwood chips are destructured prior to said step (a).

3. The pulping process of claim 2 wherein said hardwood chips are subjected to steam prior to being destructured.

4. The pulping process of claim 3 wherein said hardwood chips are destructured by compressing said chips and said chips are impregnated with said alkaline liquor by allowing said compressed chips to expand in said liquor.

5. The pulping process of claim 4 wherein said alkaline softened chips of step (b) are compressed to remove said spent liquor from said chips and said chips are impregnated with said sulfite liquor by allowing said compressed chips to expand in said sulfite liquor.

6. The pulping process of claim 5 wherein said chips are maintained in said alkaline liquor for a period of approximately 5 minutes to 3 hours.

7. The pulping process of claim 6 wherein said chips are maintained in said sulfite liquor for a period of approximately 15 to 45 minutes.

8. The pulping process of claim 7 wherein said chips are defibrated at a consistency of approximately 10 to 35%.

9. The pulping process of claim 1 wherein said alkaline liquor additionally contains approximately 0.5 to 4% hydrogen peroxide based on dry wood chips.

10. The pulping process of claim 1 wherein said sulfite liquor has a ph of about 5 to 9.

11. A process for the production of chemithermomechanical hardwood pulp, said process being characterized by a pulp yield of at least 80% based on dry wood chips; said process comprising the steps of:

(a) steaming hardwood chips;

(b) compressing said steamed chips to destructure said chips;

(c) impregnating said compressed chips with an alkaline peroxide liquor by allowing said compressed chips to expand in said alkaline peroxide liquor, said alkaline peroxide liquor being an aqueous solution containing about 0.5 to about 4% hydrogen peroxide, about 3 to about 10% sodium hydroxide, both based on dry wood chips;

(d) maintaining said impregnated chips of steps (c) in said alkaline liquor for a period of approximately 5 minutes to 3 hours to permit chemical softening of said chips;

(e) compressing said alkaline softened chips of step (d) to remove the said alkaline peroxide liquor, (f) impregnating said alkaline softened chips with a sulfite liquor by allowing said compressed chips of step (e) to expand in said sulfite liquor, said sulfite liquor being an aqueous solution containing about 2 to 10% sodium sulfite or sodium bisulfite;

(g) cooking said impregnated chips of step (f) at a temperature of approximately 120° to 180° C. for approximately 15 to 45 minutes to permit further softening of said chips without removing substantial quantities of lignin from said chips;

(h) defibrating said chips of step (f) by passing said chips through a refining apparatus at a consistency of approximately 10 to 35%; and (i) recovering said pulp from said refining apparatus.

12. The pulping process of claim 11 wherein said process is carried out on a continuous basis.

13. The pulping process of claim 11 wherein said sulfite liquor contains sodium sulfite.

14. The pulping process of claim 11 wherein said chips are maintained in said sulfite liquor at a temperature of about 140° to 160° C.

15. The pulping process of claim 11 wherein said steps (b) and (e) are carried out using a screw press.

16. The pulping process of claim 11 wherein said sulfite liquor has a pH of about 5 to 9.

* * * * *